US005122502A

United States Patent [19]

Bowman et al.

[11] Patent Number: 5,122,502

[45] Date of Patent: Jun. 16, 1992

[54] COPOLYMERS OF ALKYL (2-ACRYLAMIDOMETHOXY CARBOXYLIC ESTERS) AS SUBBING/BARRIER LAYERS

[75] Inventors: Wayne A. Bowman, Walworth; Charles L. Bauer, Rochester, both of N.Y.

[73] Assignee: Eastman Kodak Company, Rochester, N.Y.

[21] Appl. No.: 728,482

[22] Filed: Jul. 11, 1991

[51] Int. Cl.[5] ..... B41M 5/035; B41M 5/26

[52] U.S. Cl. ..... 503/227; 428/195; 428/520; 428/913; 428/914

[58] Field of Search ..... 8/471; 428/195, 520, 428/913, 914; 503/227

[56] References Cited

U.S. PATENT DOCUMENTS

| | | | |
|---|---|---|---|
| 4,289,676 | 9/1981 | Czauderna et al. | 260/29.6 H |
| 4,541,830 | 9/1985 | Hotta et al. | 8/471 |
| 4,656,308 | 4/1987 | Schirmann et al. | 560/170 |
| 4,695,288 | 10/1987 | Ducharme | 8/471 |
| 4,700,208 | 10/1987 | Vanier et al. | 503/227 |
| 4,716,144 | 12/1987 | Vanier et al. | 503/227 |
| 4,727,057 | 2/1988 | Harrison et al. | 503/227 |
| 4,748,150 | 5/1988 | Vanier et al. | 503/227 |
| 4,752,598 | 6/1988 | Yubakami et al. | 503/227 |
| 4,760,168 | 7/1988 | Schirmann | 560/170 |
| 4,778,869 | 10/1988 | Schirmann et al. | 526/304 |
| 4,837,200 | 6/1989 | Kondo et al. | 503/227 |
| 4,847,237 | 7/1989 | Vanderzanden | 503/227 |

FOREIGN PATENT DOCUMENTS

| | | | |
|---|---|---|---|
| 20000 | 12/1980 | European Pat. Off. | 428/474.4 |
| 224736 | 11/1986 | European Pat. Off. | 428/474.4 |
| 237643 | 12/1986 | European Pat. Off. | 428/2 |

*Primary Examiner*—Bruce H. Hess
*Attorney, Agent, or Firm*—Clyde E. Bailey

[57] ABSTRACT

Dye donor elements and assemblages for thermal dye transfer processing comprising a polymeric support having thereon, in order, a subbing layer and a dye layer comprising a dye dispersed in a binder, and wherein the subbing layer comprises a copolymer having recurring monomer units derived from at least one linear vinyl copolymer comprising:

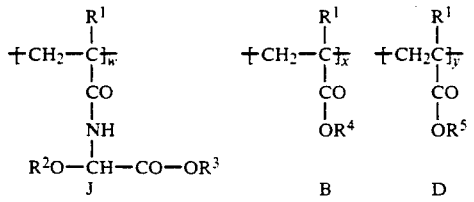

wherein:

each $R^1$ is, independently, H or methyl;

$R^2$ and $R^3$ each, independently, represents:

a) a substituted or unsubstituted alkyl group of 1 to 6 carbon atoms; or b) a substituted or unsubstituted cycloalkyl group of 5 to 8 carbon atoms;

$R^4$ represents:

a) a substituted or unsubstituted alkyl group of 2 to 4 carbon atoms substituted with at least 1 hydroxyl group; or b) from 2 to about 20 ethoxy groups substituted with at least 1 hydroxyl group;

$R^5$ represents:

a) a substituted or unsubstituted alkyl group of 1 to 12 carbon atoms; or b) a substituted or unsubstituted cycloalkyl group of 5 to 8 carbon atoms; w represents 5 to 50 weight-percent; x represents 0 to 40 weight-percent; and y represents 50 to 95 weight-percent.

20 Claims, No Drawings

COPOLYMERS OF ALKYL (2-ACRYLAMIDOMETHOXY CARBOXYLIC ESTERS) AS SUBBING/BARRIER LAYERS

TECHNICAL FIELD

This invention relates to dye-donor elements used in thermal dye transfer, and more particularly to the use of a certain subbing layer between a polymeric support and a dye layer comprising a dye dispersed in a binder.

BACKGROUND OF THE INVENTION

In recent years, thermal transfer systems have been developed to obtain prints from a color video camera. According to one way of obtaining such prints, an electronic picture is first subjected to color separation by color filters. The respective color-separated images are then converted into electrical signals. These signals are then operated on to produce cyan, magenta and yellow electrical signals Then the signals are transmitted to a thermal printer. To obtain the print, a cyan, magenta and yellow dye-donor element is placed face-to-face with a dye receiving element. The two are then inserted between a thermal printing head and a platen roll. A line-type thermal printing head is used to apply heat from the back of the dye-donor sheet. The thermal printing head has many heating elements and is heated up sequentially in response to the cyan, magenta and yellow signals. The process is then repeated for the other two colors. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Titanium alkoxides (such as Tyzor TBT ® (titanium tetra-n-butoxide of duPont)) have been used as subbing layers between a polyester support and a dye-layer. While these materials are excellent subbing layers for adhesion purposes, problems have arisen with hydrolytic instability and they are difficult to coat in a reproducible manner. It has also been observed that degradation of dyes in the dye-donor can occur when titanium alkoxides are used as a subbing layer. This problem is particularly prevalent with arylidene pyrazolone yellow dyes. The subbing layers of the prior art may also have problems in that when a thin layer of polyester support is used for the dye-donor there is a greater tendency for layer delamination, particularly when multiple prints are attempted from a single donor.

U.S. Pat. No. 4,695,288 is directed to a dye-donor element for thermal dye transfer comprising a subbing layer comprising recurring units of an ethylenically unsatuated monomer and recurring units of an ethylenicaly unsatuated carboxylic acid.

SUMMARY OF THE INVENTION

It is therefore an object of this invention to provide a subbing layer for a dye-donor element that greatly reduces the tendency for dye layer delamination.

Another object of the invention is to provide a dye-donor element having a subbing layer that improves dye layer stability.

Accordingly, for accomplishing these and other objects of the invention, there is provided a dye donor element for thermal dye transfer comprising a polymeric support having thereon, in order, a subbing layer and a dye layer comprising a dye dispersed in a binder, and wherein the subbing layer comprises a copolymer having a glass transition temperature below 50° C., comprising recurring monomer units derived from at least one linear vinyl copolymer comprising:

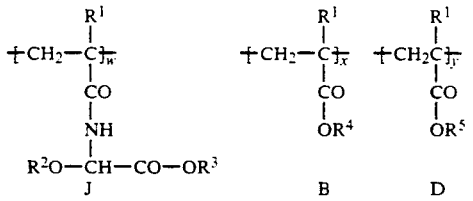

wherein:

each $R^1$ is, independently, H or methyl;

$R^2$ and $R^3$ each, independently, represents a substituted or unsubstituted alkyl group of 1 to 6 carbon atoms, such as, methyl, ethyl, propyl, butyl or hexyl, or a substituted or unsubstituted cycloalkyl group of 5 to 8 carbon atoms, such as cylcohexyl;

$R^4$ represents:

a) a substituted or unsubstituted alkyl group of 2 to 4 carbon atoms substituted with at least 1 hydroxyl group; or b) from 2 to about 20 ethoxy groups substituted with at least 1 hydroxyl group;

$R^5$ represents a substituted or unsubstituted alkyl group of 1 to 12 carbon atoms, such as, methyl, ethyl, propyl, butyl, hexyl, lauryl, or 2-ethylhexyl, or a substituted or unsubstituted cycloalkyl group of 5 to 8 carbon atoms, such as cyclohexyl;

w represents 5 to 50 weight-percent;

x represents 0 to 40 weight-percent; and y represents 50 to 95 weight-percent.

DETAILED DESCRIPTION OF THE INVENTION

In a preferred embodiment of the invention, the copolymer comprises recurring units of: monomer J wherein $R^1$ is hydrogen and $R^2$ and $R^3$ are each methyl; monomer B wherein $R^1$ is methyl and $R^4$ is 2-hydroxyethyl; and, monomer D wherein $R^1$ is hydrogen and $R^5$ is butyl. In another preferred embodiment, the glass transition temperature of the copolymer is 20° C. In still another preferred embodiment, the concentration of both monomers J and B in the copolymer is 25 weight-percent.

In another preferred embodiment, the copolymer comprises monomer J, wherein $R^1$ is hydrogen, $R^2$ and $R^3$ both methyl, present in the copolymer at about 25 weight-percent; and, monomer D, wherein $R^1$ is hydrogen and $R^5$ is butyl, present at about 75 weight-percent. The glass transition temperature of this copolymer is −10° C.

The copolymer may also be described as $J_nD_{100-n}$. Although these two monomers are required, the inclusion of one or more other monomeric units, such as B monomer, is permitted provided they do not alter the essential properties of the copolymer.

The copolymer $J_nD_{100-n}$ is such that n is 5 to 40 weight-percent, preferably 20 to 30 weight percent. The balance of the copolymer represented by D alone or D with one or more other copolymerizable monomers is present in the copolymer in an amount representing the difference from the J component.

The copolymer $J_nD_{100-n}$ of the present invention may be used alone as the subbing layer or may be used in combination with a Group IVA or IVA metal alkoxide or an acid or amine cross-linking catalyst such as p-toluene sulfonic acid or propanediamine.

Two particularily favored B-monomers for copolymerization with the J-monomer are 2-hydroxyethyl methacrylate and 2-hydroxyethyl acrylate.

The following copolymers are included within the scope of the invention:

J is the methyl 2-acrylamido-2-methoxy acetate component:

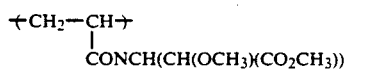

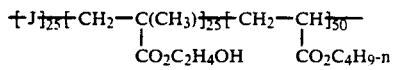

E-1

Tg = 20° C.

As E-1 but 15:25:60 weight ratio Tg = 1° C. E-2

As E-1 but 5:25:70 weight ratio Tg = −17° C. E-3
Copolymers with 2-hydroxyethyl methacrylate and n-butyl acrylate

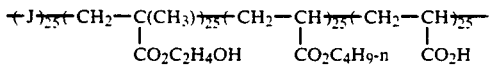

E-4

A copolymer with 2-hydroxyethyl methyacrylate, n-butyl acrylate, and acrylic acid. Tg = 15° C.

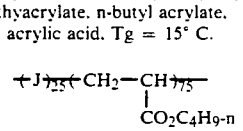

E-5

A copolymer with n-butyl acrylate, Tg = −10°C.

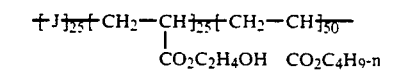

E-6

A copolymer with 2-hydroxyethyl acrylate and n-butyl acrylate, Tg = −5° C.

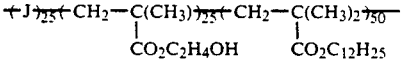

E-7

A copolymer with 2-hydroxyethyl methacrylate and lauryl methacrylate, Tg = 37° C.

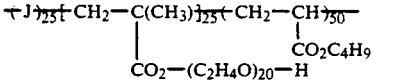

E-8

A copolymer with polyethyleneglycol-monomethacrylate and butyl acrylate, Tg = 30° C.

The subbing layer of the invention may be employed at any concentration which is effective for the intended purpose. In general, good results have been obtained at about 0.01 to 0.3 g/m² total coverage of composite, preferably 0.02 to 0.1 g/m².

Any polymeric binder may be employed in the dye donor element of the invention. In a preferred embodiment, the binder contains hydroxyl, amino, thio, amido, and/or carboxyl groups. For example there may be employed cellulosic binders, such as cellulose acetate, cellulose triacetate (fully acetylated) or a cellulose mixed ester such as cellulose acetate butyrate, cellulose acetate hydrogen phthalate, cellulose acetate formate, cellulose acetate propionate, cellulose acetate pentanoate, cellulose acetate hexanoate, cellulose acetate heptanoate, or cellulose acetate benzoate.

The polymeric binder in the dye-donor element of the invention may be employed at any concentration which is effective for the intended purpose. In general, good results have been obtained at about 0.05 to about 5 g/m² of coated element.

Any polymeric material can be used as the support for the dye-donor element of the invention provided it is dimensionally stable and can withstand the heat of the thermal printing head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness from about 5 to about 30 mm.

Any dye can be used in the dye layer of the dye-donor element of the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

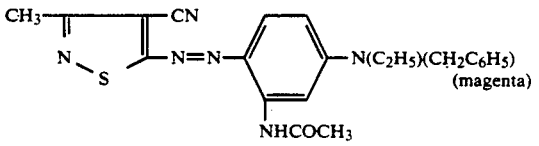

(magenta)

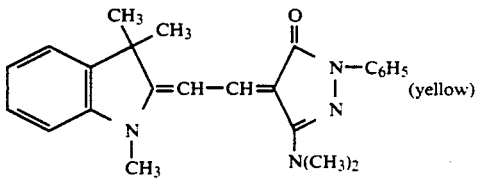

(yellow)

-continued

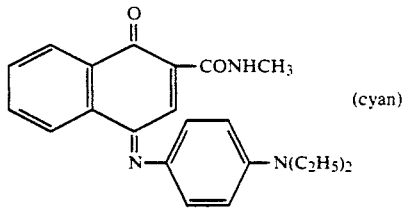

(cyan)

or any of the dyes disclosed in U.S. Pat. Nos. 4,541,830; 4,698.651; 4,695,287; 4,701,439; 4,757,046; 4,743,582; 4,769.360; and 4,753,922; the disclosures of which are hereby incorporated by reference. The above dyes may be employed singly or in combination. The dyes may be used at a coverage of from about 0.05 to about 1 g/m$^2$ and are preferably hydrophobic.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate). beeswax, perfluorinated alkyl ester polyethers, poly(capro-lactone), silicone oil, poly(tetrafluoroethylene). carbowax®, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate. cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight-percent, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as duPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed. it may have alternating areas of other different dyes or combinations, such as sublimable cyan and/or yellow and/or magenta and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element. The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The invention will be further clarified by a consideration of the following examples, which are intended to be purely exemplary of the use of the invention.

EXAMPLE 1

Yellow dye-donor elements were prepared by coating the following layers in order on a 6 micron poly(ethylene terephthalate) support.

1) subbing layer as specified (0.11 g/m$^2$)of the indicated copolymer indicated below and illustrated above from methanol.

2) Dye layer containing the yellow dye identified below (0.15 g/m$^2$), and cellulose acetate propionate binder (2.5% acetyl and 45% propionyl) (0.37 g/m$^2$) coated from a toluene, methanol and cyclopentanone solvent mixture (65/30/5).

Yellow Dye

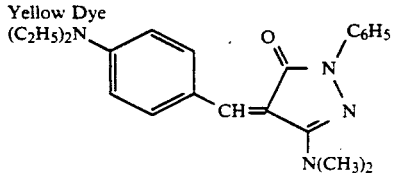

On the backside of the dye-donor element was coated: a slipping-layer of Emralon 329 polytetrafluoroethylene dry film lubricant (Acheson Colloids) (0.54 g/m$^2$) from a n-propyl acetate, toluene, and methanol solvent mixture.

Control dye-donors were prepared as described above except a different subbing layer (at 0.11 g/m$^2$) was coated underneath the dye layer:

No subbing layer — C-1

Tyzor TBT ® only — C-2

$$\text{-}(CH_2-\underset{CO_2C_4H_9\text{-}n}{CH})_{40}\text{-}(CH_2-\underset{CO_2C_2H_4NH_2HCl}{C(CH_3)})_{20}\text{-}(CH_2-\underset{CO_2C_2H_4OH}{C(CH_3)})_{40}\text{-} \quad \text{C-3}$$

A copolymer of n-butyl acrylate, 2-aminoethyl methacrylate hydrochloride, and 2-hydroxyethyl methacrylate (40:20:40 weight ratio)

As C-3 but 50:15:35 weight ratio rather than 40:20:40 — C-4

$$\text{-}(CH_2-\underset{CO_2C_4H_9\text{-}n}{C(CH_3)})_n\text{-} \quad \text{C-5}$$

poly(n-butyl methacrylate)

The following comparison polymers all involve methyl 2-acrylamido-2-methoxy acetate, J, as a monomer, but are outside the definition of the invention, primarily because of high $T_g$ (all ratios are weight ratios)

$$J = \text{-}(CH_2-\underset{CONCH(CH(OCH_3)(CO_2CH_3))}{CH})\text{-}$$

$$\text{-}(J)_{25}\text{-}(CH_2-\underset{CO_2C_2H_4OH}{C(CH_3)})_{25}\text{-}(CH_2-\underset{CO_2C_4H_9\text{-}n}{C(CH_3)})_{50}\text{-} \quad \text{C-6}$$

A copolymer with 2-hydroxyethyl methacrylate and n-butyl methacrylate, Tg = 53° C.

$$\text{-}(J)_{25}\text{-}(CH_2-\underset{CO_2C_2H_4OH}{C(CH_3)})_{25}\text{-}(CH_2-\underset{CONHC-(CH_3)_2-C_4H_9\text{-}t}{CH})_{50}\text{-} \quad \text{C-7}$$

A copolymer with 2-hydroxyethyl methacrylate and t-octylacrylamide, Tg = 124° C.

$$\text{-}(J)_{25}\text{-}(CH_2-\underset{CO_2C_2H_4OH}{C(CH_3)})_{75}\text{-} \quad \text{C-8}$$

A copolymer with 2-hydroxyethyl methacrylate, Tg = 88° C.

$$\text{-}(J)_{25}\text{-}(CH_2-\underset{CO_2C_2H_4OH}{CH})\text{-}(CH_2-\underset{C_6H_5}{CH})\text{-} \quad \text{C-9}$$

A copolymer with 2-hydroxyethyl acrylate and styrene, Tg = 70° C.

All dye-donor coatings including those with the control subbing layers were dried at 40° C. for 50 sec and then 65° C. for 200 sec to insure crosslinking of the polymer.

A dye-receiving element was prepared by coating the following layers in the order recited over a white reflective support of titanium dioxide-pigmented polyethylene overcoated paper stock:

1) a subbing layer of poly(acrylonitrile-co-vinylidene chloride-co-acrylic acid) (14:79:7 wt. ratio) (0.08 g/m$^2$) coated from butanone;

2) a dye-receiving layer of Makrolon 5700, a bisphenol A-polycarbonate resin (Bayer AG) (2.9 g/m$^2$), Tone PCL-300 polycaprolactone (Union Carbide) (0.38 g/m$^2$), and 1,4-didecoxy-2, 6-dimethoxyphenol (0.38 g/m$^2$) coated from methylene chloride; and 3) overcoat layer of Tone PCL-300 polycaprolactone (Union Carbide) (0.11 g/m$^2$), FC-431 fluorocarbon surfactant (3M Corp.) (0.011 g/m$^2$) and DC-510 Silicone Fluid (Dow Corning) (0.01 g/m$^2$) coated from methylene chloride.

The dye-side of a dye-donor element strip approximately 10 cm × 13 cm in area was place in contact with the image-receiver layer side of a dye-receiver element of the same area. This assemblage was clamped to a stepper-motor driven 60 mm diameter rubber roller. A TDK Thermal Head L-231 (thermostated at 23.5° C.) was pressed with a spring at a force of 36N against the dye-donor element side of the assemblage pushing it against the rubber roller.

The imaging electronics were activated causing the donor-receiver assemblage to be drawn through the printing head/roller nip at 6.9 mm/sec. Coincidentally the resistive elements in the thermal print head were pulsed for 20 μsec/pulse at 128 μsec intervals during the 33 msec/dot printing time. A stepped density image as generated by incrementally increasing the number of pulses/dot from 0 to 255. The voltage supplied to the printing head was approximately 24.5 volts, resulting in an instantaneous peak power of 1.4 watts/dot and maximum total energy of 10.5 mJoules/dot.

The Status A Blue maximum density of each of the stepped images was read and recorded.

Using the same area of receiver, a stepped image using an unused yellow dye donor area was recorded on top of the first stepped image. Note was made of any sticking when the donor was separated from the receiver. This was repeated for up to twelve or more printings of dye-donor onto the same receiver. Sticking of the donor to the receiver, and retention of part or all of the donor dye layer on the receiver indicated a poor adhesion and weak bond for the subbing layer. The number of transfers that could be made to the receiver before sticking occurred was also recorded as "prints to fail".

To evaluate dye stability of the dye-donor, the Status A Blue transmission density of the dye-donor was read as coated and again after incubation for one week in the dark at 49° C. and 50% RH. The percent decrease in density was calculated as indicative of dye loss.

The following results were obtained:

TABLE 1

| SUBBING LAYER | | Maximum Density Status | Prints | Incubation Dye Loss |
|---|---|---|---|---|
| Copolymer | $T_g$ | A Blue | to Fail | (Percent) |
| E-1 | 20° C. | 2.8 | >12 | 4 |
| E-1* | 20° C. | 2.5 | >12 | <4 |
| E-2 | 1° C. | 2.6 | >12 | <4 |
| E-3 | −17° C. | 2.5 | >12 | <4 |
| E-4 | 15° C. | 2.6 | >12 | <4 |
| E-5 | −10° C. | 2.5 | >12 | <4 |
| E-6 | −5° C. | 2.6 | >12 | <5 |
| C-1 (none) | | 2.5 | 3 | <4 |
| C-2 (control) (See U.S. Pat. No. 4,737,486) | | 2.6 | >12 | 18 |
| C-3 (control) | | 2.6 | 4 | 46 |
| C-4 (control) (See U.S. Pat. No. 4,700,208) | | 2.4 | >12 | 66 |
| C-5 (control) | | 2.3 | 1 | <4 |
| C-6 (comparison) Tg = 124° C. | | 2.5 | 1 | <4 |

TABLE 1-continued

| SUBBING LAYER | | Maximum Density Status | Prints | Incubation Dye Loss |
|---|---|---|---|---|
| Copolymer | $T_g$ | A Blue | to Fail | (Percent) |
| C-7 (comparison) Tg = 124° C. | | 2.5 | 3 | <4 |
| C-8 (comparison) Tg = 88° C. | | 2.8 | 4 | <4 |
| C-9 (comparison) Tg = 70° C. | | 2.5 | 3 | <4 |

*This is the same polymer as E-1 (0.11 g/m²), but also contained 10 weight percent Tyzor TBT ®.

The results show that the subbing layer of the invention coated between the support and dye layer provide both improved adhesion (greater number of prints before separation failure) and less loss of dye due to decomposition within the dye-donor itself than the control subbing layers of the titanium alkoxide or a prior art poly(alkyl acrylate ester). Dye donors with polymers above $T_g$ 50° C. either gave low transferred dye density or low number of repeat prints before separation failure.

EXAMPLE 2

This example is similar to Example 1 but shows the effectiveness of the subbing layer is maintained at different coverages of the copolymers of the invention.

Dye donor elements were prepared as in Example 1.

Dye receiver elements were prepared as in Example 1.

Data for maximum transferred density, repeat printing sticking, and dye-density loss of the donor were evaluated as in Example 1.

The following results were obtained:

TABLE 2

| Copolymer | Sub Layer Coverage (g/m²) | Maximum Density Status A Blue | Prints to Fail | Incubation Dye Loss (Percent) |
|---|---|---|---|---|
| E-1 | 0.054 | 2.9 | 3 | <4 |
| E-1 | 0.011 | 2.9 | 5 | <4 |
| E-1 | 0.022 | 2.9 | 6 | <4 |
| E-1 | 0.054 | 2.9,2.8 | >12 | <4 |
| E-1 | 0.11 | 2.8,2.8 | >12 | <4.9 |
| E-1 | 0.22 | 2.7 | >12 | <4 |
| E-6 | 0.054 | 2.8 | >12 | <4 |
| E-6 | 0.11 | 2.7 | >12 | <4 |
| E-6 | 0.22 | 2.7 | >12 | <4 |
| E-7 | 0.01 | 2.5 | >12 | <4 |
| E-8 | 0.01 | 2.8 | >12 | <4 |

The above illustrates the invention at different polymer coverages.

The invention has been described in detail with particular reference to preferred embodiments thereof, but it will be understood that variations and modifications can be effected within the spirit and scope of the invention.

What is claimed is:

1. In a dye donor element for thermal dye transfer comprising a polymeric support having thereon, in order, a subbing layer and a dye layer comprising a dye dispersed in a binder, the improvement wherein said subbing layer comprises a copolymer having a glass transition temperature below 50° C. comprising recurring monomer units derived from at least one linear vinyl copolymer comprising:

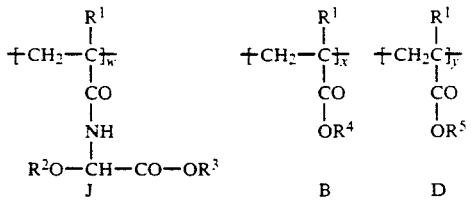

wherein:

each $R^1$ is, independently, H or methyl;

$R^2$ and $R^3$ each, independently, represents:

a) a substituted or unsubstituted alkyl group of 1 to 6 carbon atoms; or b) a substituted or unsubstituted cycloalkyl group of 5 to 8 carbon atoms;

$R^4$ represents:

a) a substituted or unsubstituted alkyl group of 2 to 4 carbon atoms substituted with at least 1 hydroxyl group; or b) from 2 to about 20 ethoxy groups substituted with at least 1 hydroxyl group;

$R^5$ represents:

a) a substituted or unsubstituted alkyl group of 1 to 12 carbon atoms; or b) a substituted or unsubstituted cycloalkyl group of 5 to 8 carbon atoms;

w represents 5 to 50 weight-percent;

x represents 0 to 40 weight-percent; and y represents 50 to 95 weight-percent.

2. The element of claim 1 wherein:

a) in monomer J:

$R^1$ is hydrogen; and, $R^2$ and $R^3$ are each methyl;

b) in monomer B:

$R^1$ is methyl; and $R^4$ is 2-hydroxyethyl; and, c) in monomer D:

$R^1$ is hydrogen; and $R^5$ is butyl.

3. The element of claim 2 wherein the copolymer has a glass transition temperature of 20° C.

4. The element of claim 1 wherein monomer J and monomer B are each present in the copolymer at about 25 weight-percent.

5. The element of claim 1 wherein:

a) in monomer B, x is 0;

b) in monomer J:

$R^1$ is hydrogen; and $R^2$ and $R^3$ are each methyl;

c) in monomer D:

$R^1$ is hydrogen; and $R^5$ is butyl.

6. The element of claim 5 wherein monomer J is present in the copolymer at about 25 weight-percent and monomer D at about 75 weight-percent.

7. The element of claim 5 wherein the copolymer has a glass transition temperature of −10° C.

8. In a process of forming a dye transfer image comprising:

(A) imagewise-heating a dye-donor element comprising a polymeric support having thereon, in order, a subbing layer and a dye layer comprising a dye dispersed in a binder, and (B) transferring a dye image to a dye-receiving element to form said dye transfer image, the improvement wherein said subbing layer comprises a copolymer having a glass transition temperature below 50° C., comprising recurring monomer units derived from at least one linear vinyl copolymer comprising:

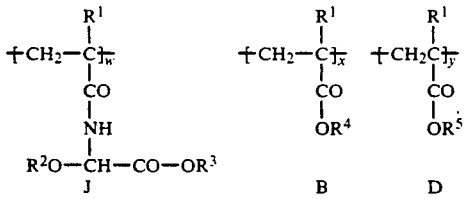

wherein:

each $R^1$ is, independently, H or methyl;

$R^2$ and $R^3$ each, independently, represents:

a) a substituted or unsubstituted alkyl group of 1 to 6 carbon atoms; or b) a substituted or unsubstituted cycloalkyl group of 5 to 8 carbon atoms;

$R^4$ represents:

a) a substituted or unsubstituted alkyl group of 2 to 4 carbon atoms substituted with at least 1 hydroxyl group; or b) from 2 to about 20 ethoxy groups substituted with at least 1 hydroxyl group;

$R^5$ represents:

a) a substituted or unsubstituted alkyl group of 1 to 12 carbon atoms; or b) a substituted or unsubstituted cycloalkyl group of 5 to 8 carbon atoms;

w represents 5 to 50 weight-percent;

x represents 0 to 40 weight-percent; and y represents 50 to 95 weight-percent.

9. The process of claim 8 wherein:

a) in monomer J:

$R^1$ is hydrogen; and, $R^2$ and $R^3$ are each methyl;

b) in monomer B:

$R^1$ is methyl; and $R^4$ is 2-hydroxyethyl; and, c) in monomer D:

$R^1$ is hydrogen; and $R^5$ is butyl.

10. The process of claim 8 wherein the copolymer has a glass transition temperature of about 20° C.

11. The process of claim 8 wherein monomer J and monomer B are each present in the copolymer at about 25 weight-percent.

12. The process of claim 8 wherein:

a) in monomer B, x is 0;

b) in monomer J:

$R^1$ is hydrogen; and $R^2$ and $R^3$ are each methyl;

c) in monomer D:

$R^1$ is hydrogen; and $R^5$ is butyl.

13. The process of claim 12 wherein monomer J is present in the copolymer at about 25 weight-percent and monomer D at about 75 weight-percent.

14. The process of claim 12 wherein the copolymer has a glass transition temperature of −10° C.

15. In a thermal dye transfer assemblage comprising:

(A) a dye-donor element comprising a polymeric support having thereon, in order, a subbing layer and a dye layer comprising a dye dispersed in a binder and (B) a dye-receiving element comprising a support having thereon a dye image receiving layer, said dye-receiving element being in superposed relationship with said dye-donor element so that said dye layer is in contact with said dye image receiving layer, the improvement wherein said subbing layer comprises a copolymer having a glass transition temperature below 50° C., comprising recurring monomer units derived from at least one linear vinyl copolymer comprising:

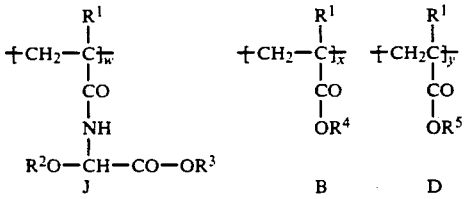

wherein:

each $R^1$ is, independently, H or methyl;

$R^2$ and $R^3$ each, independently, represents:

a) a substituted or unsubstituted alkyl group of 1 to 6 carbon atoms; or b) a substituted or unsubstituted cycloalkyl group of 5 to 8 carbon atoms;

$R^4$ represents:

a) a substituted or unsubstituted alkyl group of 2 to 4 carbon atoms substituted with at least 1 hydroxyl group; or b) from 2 to about 20 ethoxy groups substituted with at least 1 hydroxyl group;

$R^5$ represents:

a) a substituted or unsubstituted alkyl group of 1 to 12 carbon atoms; or b) a substituted or unsubstituted cycloalkyl group of 5 to 8 carbon atoms;

w represents 5 to 50 weight-percent;

x represents 0 to 40 weight-percent; and y represents 50 to 95 weight-percent.

16. The assemblage of claim 15 wherein a) in monomer J:

$R^1$ is hydrogen; and, $R^2$ and $R^3$ are each methyl;

b) in monomer B:

$R^1$ is methyl; and $R^4$ is 2-hydroxyethyl; and, c) in monomer D:

$R^1$ is hydrogen; and $R^5$ is butyl.

17. The assemblage of claim 15 wherein the copolymer has a glass transition temperature of 20° C.

18. The assemblage of claim 15 wherein monomer J and monomer B are each present in the copolymer at about 25 weight-percent.

19. The assemblage of claim 15 wherein:

a) in monomer B, x is 0;

b) in monomer J:

$R^1$ is hydrogen; and $R^2$ and $R^3$ are each methyl;

c) in monomer D:

$R^1$ is hydrogen; and $R^5$ is butyl.

20. The assemblage of claim 19 wherein monomer J and monomer B are each present in the copolymer at about 25 weight-percent and said copolymer has a glass transition temperature of −10° C.

* * * * *